US006135101A

United States Patent [19]

Konno et al.

[11] Patent Number: 6,135,101

[45] Date of Patent: Oct. 24, 2000

[54] OXYGEN CONCENTRATION SENSOR TROUBLE DISCRIMINATING APPARATUS

[75] Inventors: Yuuichi Konno, Shioya-gun; Yoshiaki Hirakata; Kenichi Machida, both of Wako, all of Japan

[73] Assignees: Keihin Corporation; Honda Giken Kogyo Kabushiki Kaisha, both of Tokyo, Japan

[21] Appl. No.: 09/323,846

[22] Filed: Jun. 2, 1999

[30] Foreign Application Priority Data

Jun. 3, 1998 [JP] Japan ..... 10-154976

[51] Int. Cl.[7] ..... F02D 41/22; F02D 41/14

[52] U.S. Cl. ..... 123/688; 73/118.1

[58] Field of Search ..... 123/479, 688; 73/23.32, 118.1; 204/401; 701/107, 109

[56] References Cited

U.S. PATENT DOCUMENTS 4,980,834 12/1990 Ikeda et al. ..... 123/688 X 5,423,203 6/1995 Namiki et al. ..... 123/688 X

*Primary Examiner*—Tony M. Argenbright

*Attorney, Agent, or Firm*—Arent Fox Kintner Plotkin & Kahn PLLC

[57] ABSTRACT

An oxygen concentration sensor trouble discriminating apparatus in which a counter executes a counting operation every time a lean state of an air-fuel ratio is detected on the basis of an output signal of an oxygen concentration sensor for the first time after a feedback control operating state was not detected. In the case where the air-fuel ratio feedback control operating state is detected, if the output signal of the oxygen concentration sensor indicates an inversion of the rich and lean states of the air-fuel ratio, a count value of the counter is reset to an initial value. When the count value is larger than a predetermined value, the oxygen concentration sensor is decided to be in trouble.

1 Claim, 3 Drawing Sheets

OXYGEN CONCENTRATION SENSOR TROUBLE DISCRIMINATING APPARATUS

BACKGROUND OF THE INVENTION

1. Field of the Invention

The invention relates to an oxygen concentration sensor trouble discriminating apparatus for discriminating trouble of an oxygen concentration sensor which detects an oxygen concentration in an exhaust gas of an internal combustion engine.

2. Description of the Related Art

In an internal combustion engine, an air-fuel ratio control is performed by using an oxygen concentration sensor, which is provided in the exhaust system, in order to control an air-fuel ratio of a mixture to be supplied to the engine to a target air-fuel ratio such as a stoichiometric air-fuel ratio. The air-fuel ratio feedback control discriminates an air-fuel ratio of the mixture actually supplied to the engine from an output signal of the oxygen concentration sensor and controls the amount of fuel or air to be supplied to the engine in accordance with the discrimination result.

In the air-fuel ratio feedback control, when trouble occurs in the oxygen concentration sensor, since the air-fuel ratio of the supply mixture cannot be accurately controlled to the target air-fuel ratio, it is important to discriminate the trouble of the oxygen concentration sensor.

Hitherto, to discriminate the trouble of the oxygen concentration sensor, an engine operating state where it is presumed that the air-fuel ratio is rich is detected in operation. The rich operating state is a state where it is detected that the engine lies within a high rotational speed region and, at the same time, a throttle valve enters a high opening degree region. When the rich operating state is detected, if a state where the air-fuel ratio is lean is detected from an output signal of the oxygen concentration sensor, it is stored. After the operation of the engine was stopped, when the engine is again operated, if an operating state in which the air-fuel ratio is presumed to be rich is obtained, in the case where a state in which the air-fuel ratio is similarly lean is detected from the output signal of the oxygen concentration sensor, it is determined that the oxygen concentration sensor is in trouble. When the trouble of the oxygen concentration sensor is determined, an air-fuel ratio control in an open loop is executed due to a fail safe function in place of the air-fuel ratio feedback control.

According to the conventional oxygen concentration sensor trouble detection, however, a fact that the oxygen concentration sensor is in trouble cannot be determined for a period of time from the start of the engine to the stop of the operation. There is, consequently, a problem such that even if the oxygen concentration sensor is actually in trouble, the trouble cannot be decided unless a timing is after the next start of the engine.

SUMMARY OF THE INVENTION

It is, therefore, an object of the invention to provide an oxygen concentration sensor trouble discriminating apparatus which can discriminate whether an oxygen concentration sensor is actually in trouble during the operation of an internal combustion engine or not in the case where trouble of the oxygen concentration sensor is detected during the operation of the engine.

According to the invention, there is provided an oxygen concentration sensor trouble discriminating apparatus for discriminating trouble of an oxygen concentration sensor to detect an oxygen concentration in an exhaust gas of an internal combustion engine, comprising: first operating state detecting means for detecting that the internal combustion engine is operating in a rich operation region where an air-fuel ratio of a supply mixture to the internal combustion engine is continuously held in a rich state; lean air-fuel ratio detecting means for detecting that an output signal of the oxygen concentration sensor indicates a lean state of the air-fuel ratio when the operation in the rich operation region is detected; second operating state detecting means for detecting whether the internal combustion engine is in a feedback control operating state in which a feedback control is performed to adjust the air-fuel ratio of the supply mixture in accordance with an output signal of the oxygen concentration sensor or not; counting means for executing a counting operation every time a lean state of the air-fuel ratio is detected for the first time by the lean air-fuel ratio detecting means after the feedback control operating state was not detected by the second operating state detecting means; means for returning a count value of the counting means to an initial value when the output signal of the oxygen concentration sensor indicates an inversion of the rich and lean states of the air-fuel ratio in the case where the feedback control operating state is detected by the second operating state detecting means; and means for deciding trouble of the oxygen concentration sensor when the count value of the counting means is larger than a predetermined value.

According to the invention with the above construction, the count value of the counting means is went ahead every time a lean state of the air-fuel ratio is detected for the first time after the feedback control operating state was not detected. When the air-fuel ratio feedback control operating state is detected, if the output signal of the oxygen concentration sensor indicates the inversion of the rich and lean states of the air-fuel ratio, the count value of the counting means is returned to the initial value. When the count value is larger than the predetermined value, the trouble of the oxygen concentration sensor is decided. Even if the output signal of the oxygen concentration sensor, therefore, shows the lean state of the air-fuel ratio during the operation in the rich operation region and the trouble of the oxygen concentration sensor is detected, unless it is subsequently confirmed that the output signal of the oxygen concentration sensor does not indicate the inversion of the rich and lean states of the air-fuel ratio in the air-fuel ratio feedback control operating state, the trouble of the oxygen concentration sensor is not decided. In the case where the trouble of the oxygen concentration sensor is detected during the operation of the internal combustion engine, therefore, whether the oxygen concentration sensor is in trouble or not can be decided during the operation while preventing an erroneous decision.

DETAILED DESCRIPTION OF THE PREFERRED EMBODIMENT

An embodiment of the present invention will now be described in detail hereinbelow with reference to the drawings.

Figure 1:
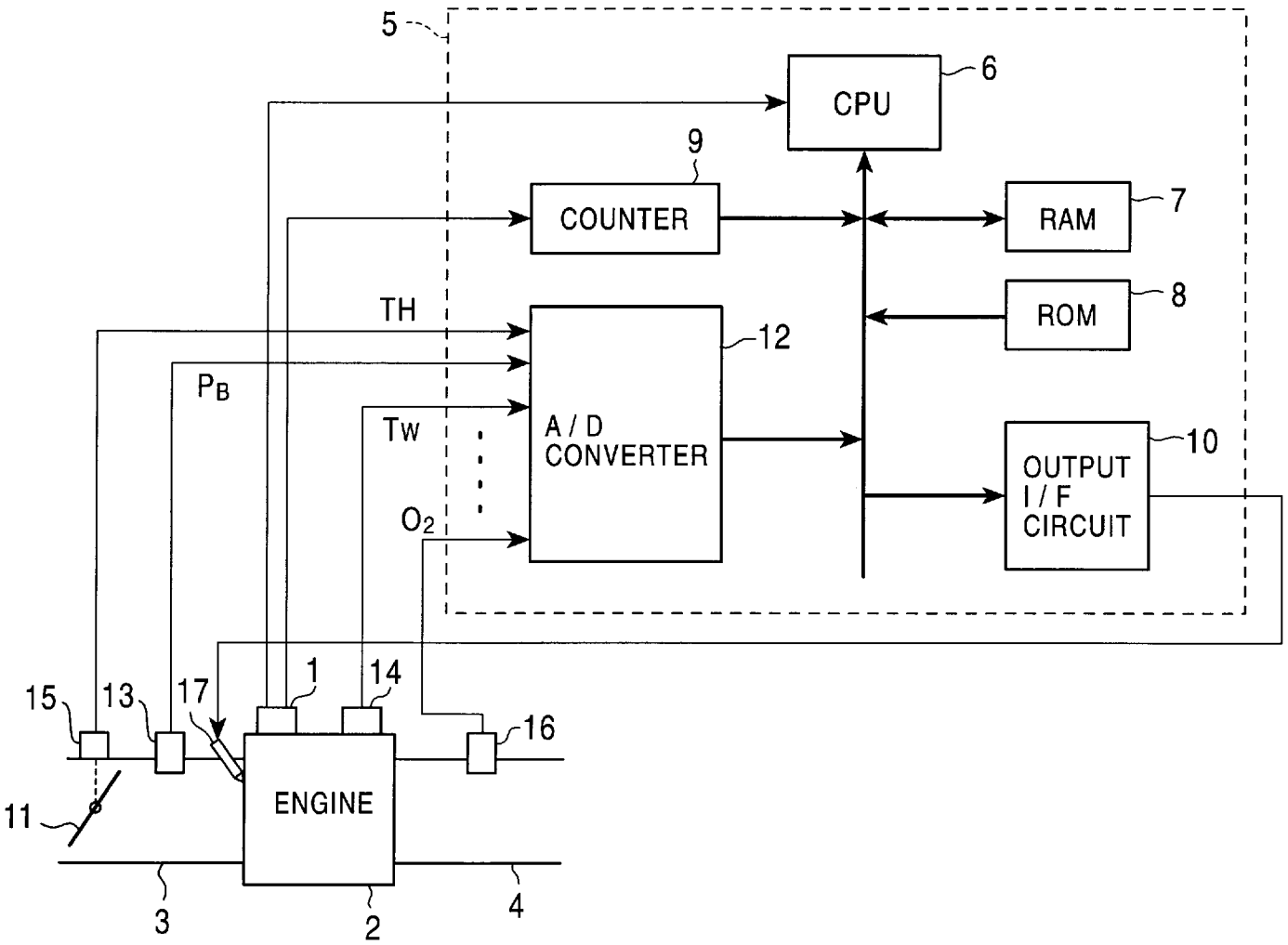
FIG. 1 is a block diagram showing an embodiment of the present invention.

FIG. 1 shows an engine control system of an internal combustion engine to which a trouble discriminating apparatus of an oxygen concentration sensor according to the present invention is applied. In the engine control system, a crank angle sensor 1 is constructed by one set or a plural sets of rotors and electromagnetic pickups (both of them are not shown). Convex portions made of a magnetic material are formed on an outer periphery of the rotor at a predetermined angle. The electromagnetic pickups are arranged near the outer periphery of the rotor. The rotor rotates in an interlocking relation with the rotation of a crank shaft (not shown) of the engine. Each time the convex portion of the rotor passes near the electromagnetic pickup, a crank pulse is generated by the electromagnetic pickup.

An ECU (Electric Control Unit) 5 is connected to an output of the crank angle sensor 1. The ECU 5 has a CPU 6, an RAM 7, an ROM 8, a counter 9, an output interface circuit 10, and an A/D converter 12. The counter 9 is reset by a crank pulse generated from the crank angle sensor 1 and counts the number of clock pulses generated from a clock generator (not shown). By counting the number of generated clock pulses, the counter 9 generates a signal indicative of an engine rotational speed Ne. All of the CPU 6, RAM 7, ROM 8, counter 9, output interface circuit 10, and A/D converter 12 are commonly connected to a bus.

The A/D converter 12 is provided to convert analog signals from a plurality of sensors for detecting engine operation parameters into digital signals. The engine operation parameters are intake pipe inner pressure $P_B$, cooling water temperature $T_W$, throttle valve opening degree TH, oxygen concentration $O_2$ in an exhaust gas, and the like which are necessary for engine control. The intake pipe inner pressure $P_B$ is detected by an intake pipe inner pressure sensor 13 provided in an intake pipe 3 on a downstream of a throttle valve 11. The cooling water temperature $T_W$ is detected by a cooling water temperature sensor 14. The throttle valve opening degree TH is detected by a throttle opening degree sensor 15. Further, the oxygen concentration $O_2$ in the exhaust gas is detected by an oxygen concentration sensor 16 provided in an exhaust pipe 4. The oxygen concentration sensor 16 is an oxygen concentration sensor of a binary output type for generating signals at levels which are different for air-fuel ratios on the rich side and the lean side by using a stoichiometric air-fuel ratio as a threshold value. The CPU 6 executes a fuel injection control routine which has previously been written in the ROM 8 and decides a fuel injection time length Tout by using those engine operation parameters and the engine rotational speed Ne. The fuel injection time length Tout is calculated, for example, by using the following calculating equation.

$$Tout = Ti \times K_{O2} \times K_{WOT} \times K_{TW} \times K_{TA} + T_{ACC} + T_{DEC}$$

where,

Ti: basic fuel injection time length as an air-fuel ratio reference control value which is determined by retrieving a data map from the ROM 8 in accordance with the engine rotational speed Ne and intake pipe inner pressure $P_B$ $K_{O2}$: air-fuel ratio correction coefficient calculated in the air-fuel ratio feedback control, $K_{WOT}$: fuel increase amount correction coefficient at the time of a high load like a full opening state of the throttle valve, $K_{TW}$: cooling water temperature correction coefficient which is set in accordance with the cooling water temperature $T_W$, $K_{TA}$: intake air temperature correction coefficient which is set in accordance with the intake air temperature $T_A$, $T_{ACC}$: acceleration increase amount value which is set in accordance with a degree of acceleration of the engine rotational speed Ne, $T_{DEC}$: deceleration decrease amount value which is set in accordance with a degree of deceleration of the engine rotational speed Ne.

The correction coefficients $K_{WOT}$, $K_{TW}$, and $K_{TA}$, acceleration increase amount value $T_{ACC}$, and deceleration decrease amount value $T_{DEC}$ are determined by retrieving the data map in the ROM 8. To instruct a fuel injection for only the fuel injection time length Tout determined as mentioned above, an injector drive command is generated from the CPU 6.

The output interface circuit 10 drives an injector 17 in response to the injector drive command from the CPU 6. The injector 17 is provided near an intake port of the intake pipe 3 of the internal combustion engine and injects a fuel when it is driven.

When the operating state of an engine body 2 (which will be simply described "engine 2" afterward) of the internal combustion engine is in an operation region where the air-fuel ratio feedback control should be performed, whether an air-fuel ratio of the supplied mixture is either rich or lean as compared with the stoichiometric air-fuel ratio is discriminated from an output level of the oxygen concentration sensor 16. The air-fuel ratio correction coefficient $K_{O2}$ is set in accordance with the discriminated result. The fuel injection time length Tout is calculated from the above calculating equation by using the set air-fuel ratio correction coefficient $K_{O2}$. The fuel is injected to the engine 2 for only the fuel injection time length Tout. The fuel is combusted in the engine 2 and an exhaust gas as a combustion result is exhausted to the exhaust pipe 4. An oxygen concentration in the exhaust gas is detected by the oxygen concentration sensor 16. By repeating this operation, the air-fuel ratio of the supply mixture is feedback controlled to the stoichiometric air-fuel ratio.

When the engine 2 is out of the operation region where the air-fuel ratio feedback control should be performed, the air-fuel ratio correction coefficient $K_{O2}$ is set to "1" irrespective of the output level of the oxygen concentration sensor 16 and is used for calculation of the fuel injection time length Tout. The air-fuel ratio feedback control is consequently stopped and the air-fuel ratio is open-loop controlled.

To perform the air-fuel ratio feedback control as mentioned above, since the oxygen concentration sensor 16 needs to be normally operating, the CPU 6 executes a fail safe process with respect to the oxygen concentration sensor 16 as follows. The fail safe process is, for example, repetitively executed every equal time interval that is determined by the clock pulses or synchronously with a specific crank pulse.

Figure 2:
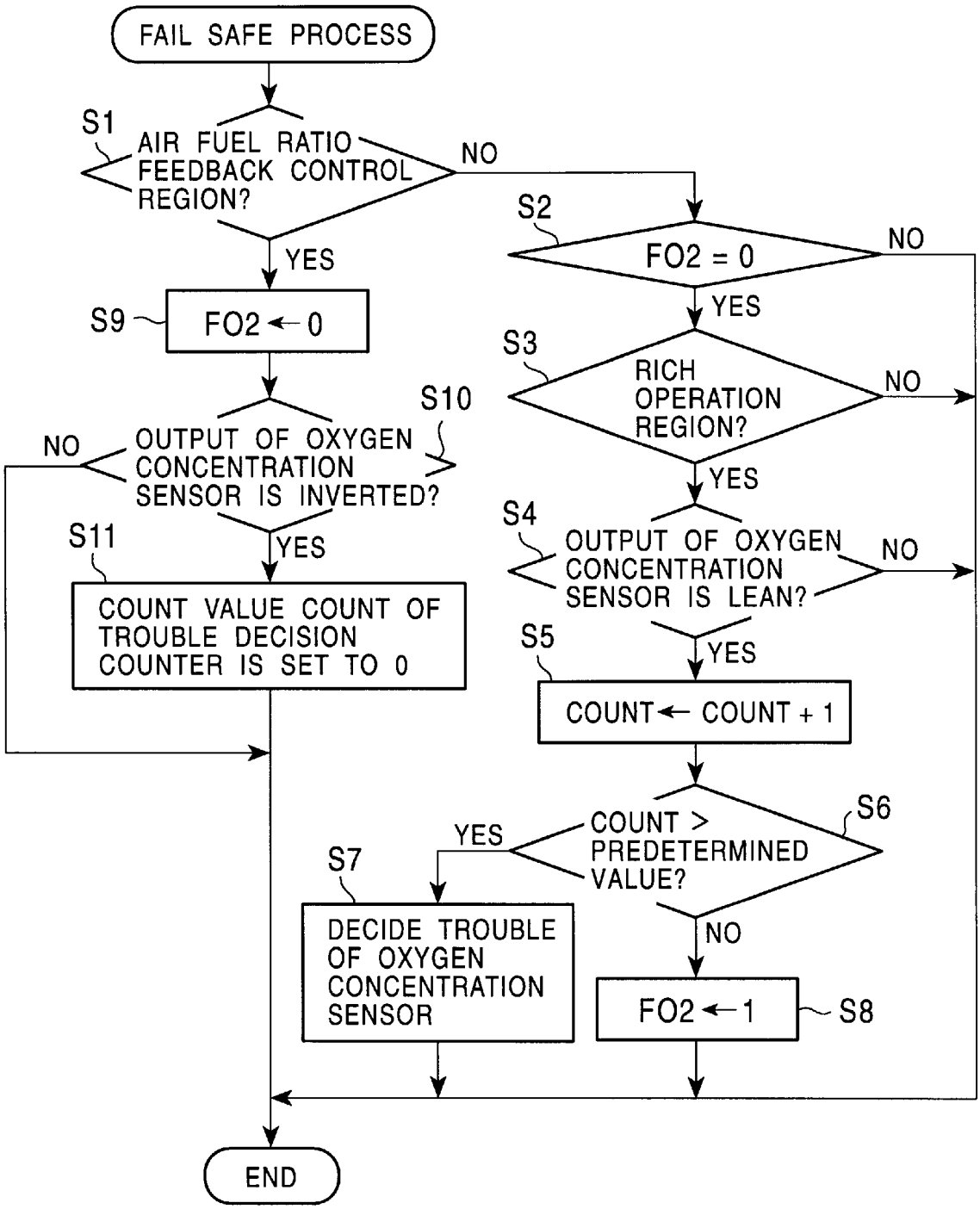
FIG. 2 is a flowchart showing a fail safe processing routine.
Figure 3:
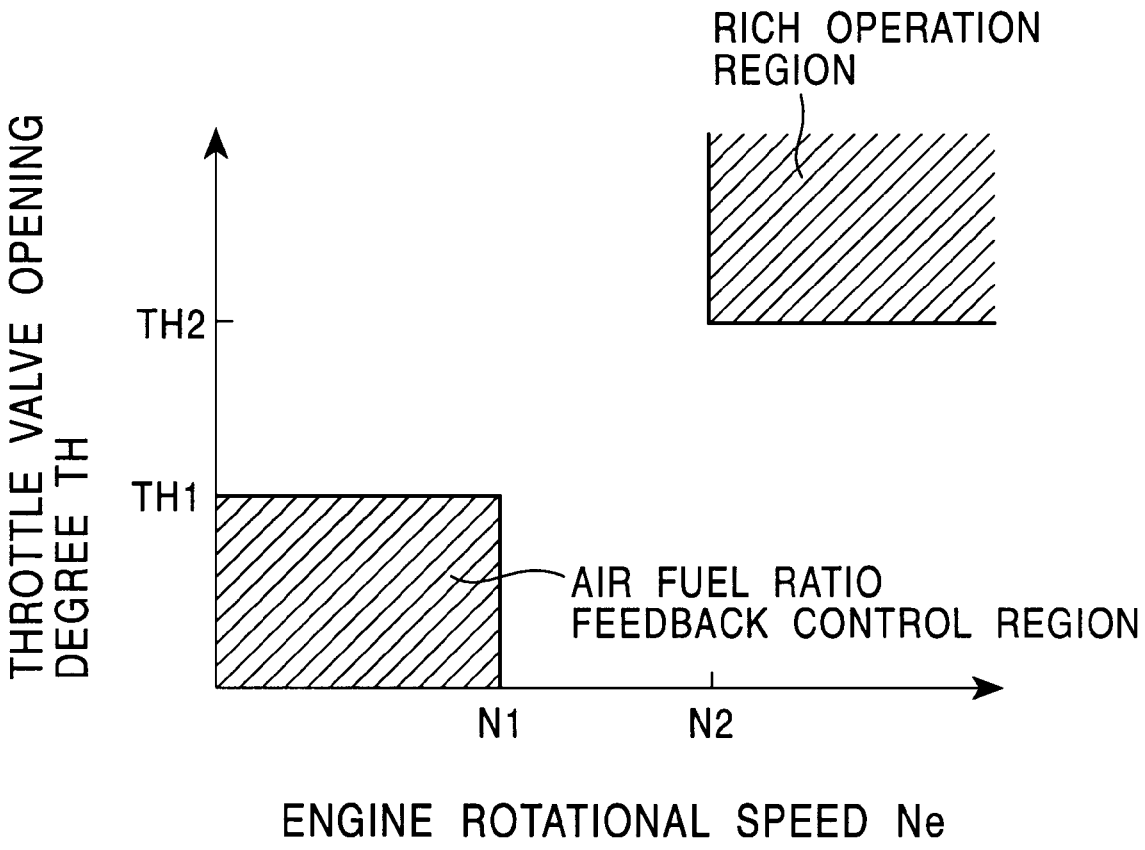
FIG. 3 is a diagram showing an air-fuel ratio feedback control region and a rich operation region.

In the fail safe process, as shown in FIG. 2, the CPU 6 first discriminates whether the current operating state of the engine 2 lies within the air-fuel ratio feedback control region or not (step S1). As shown in FIG. 3, the air-fuel ratio feedback control region is a region which is set on the basis of the engine rotational speed Ne and throttle valve opening degree TH. That is, it is a region where the engine rotational speed Ne is equal to or less than a predetermined rotational speed N1 and the throttle valve opening degree TH is equal to or less than a predetermined opening degree TH1. The engine rotational speed Ne is obtained from the counter 9. The throttle valve opening degree TH is obtained from an output of the throttle opening degree sensor 15 via the A/D converter 12.

When the operating state of the engine 2 is out of the air-fuel ratio feedback control region, whether an oxygen concentration sensor trouble discrimination permission flag FO2 is equal to "0" indicative of the permission or not (step S2). When FO2=0, a check is made to see if the current operating state of the engine 2 lies within a rich operation region for discriminating trouble of the oxygen concentration sensor 16 (step S3). The rich operation region is an operation region such that the air-fuel ratio of the supply mixture maintains a rich state and is a region where the engine rotational speed Ne is equal to or larger than a predetermined rotational speed N2 and the throttle valve opening degree TH is equal to or larger than a predetermined opening degree TH2 as shown in FIG. 3. When the current operating state of the engine 2 lies within the rich operation region, whether the output level of the oxygen concentration sensor 16 is equal to the low level showing the lean state of the air-fuel ratio or not is discriminated (step S4).

In the rich operation region, since the air-fuel ratio of the supply mixture should be richer than the stoichiometric air-fuel ratio, if the output level of the oxygen concentration sensor 16 shows the lean state of the air-fuel ratio, the oxygen concentration sensor 16 is not normal but is in a trouble state. When the output level of the oxygen concentration sensor 16 shows the lean state of the air-fuel ratio, a count value COUNT of a trouble decision counter is increased by only "1" (step S5). Whether the count value COUNT of the trouble decision counter is larger than a predetermined value (for example, 2) or not is discriminated (step S6). If COUNT>predetermined value, the oxygen concentration sensor 16 is determined to be in trouble (step S7). When COUNT<predetermined value, the oxygen concentration sensor trouble discrimination permission flag FO2 is set to "1" (step S8). Since FO2 is set to "1", even if the processing routine advances to step S2 because it is determined in step S1 that the current operating state is out of the air-fuel ratio feedback control region at the time of the execution of a next fail safe process, the processes in step S3 and subsequent steps are not executed, so that the oxygen concentration sensor 16 is not decided to be in trouble.

If it is determined in step S1 that the current operating state of the engine 2 lies within the air-fuel ratio feedback control region, the oxygen concentration sensor trouble discrimination permission flag FO2 is reset to "0" (step S9). When the current operating state is in the air-fuel ratio feedback control region, the air-fuel ratio feedback control is performed and the air-fuel ratio of the mixture which is supplied to the engine 2 finely fluctuates so as to repeat the lean and rich states within a small width around the stoichiometric air-fuel ratio. So long as the oxygen concentration sensor 16 is normal, accordingly, the output level repeats the inversion. The CPU 6, therefore, discriminates whether the output level of the oxygen concentration sensor 16 has been inverted after step S9 had been executed or not (step S10). In this discrimination, for example, in a situation such that a state where the current operating state lies within the air-fuel ratio feedback control region continues, the output level of the oxygen concentration sensor 16 is read and compared with the previous output level. If the output level of the oxygen concentration sensor 16 was inverted, since the oxygen concentration sensor 16 is normal, the count value COUNT of the trouble decision counter is reset to "0" (initial value) (step S11). If the output level of the oxygen concentration sensor 16 is not inverted, since the oxygen concentration sensor 16 cannot be determined to be normal, the count value COUNT of the trouble decision counter is maintained as it is.

In the discrimination relating to the inversion of the output level of the oxygen concentration sensor 16 in step S10, it is also possible to construct such that when the execution of the inversion of a predetermined number of times (for example, three times) is detected, it is determined that the output level of the oxygen concentration sensor 16 has been inverted, and the processing routine advances to step For example, after the start of the engine 2, when the engine 2 is operated in the rich operation region since the engine rotational speed is set to a high rotational speed and the throttle valve opening degree is equal to a high throttle opening degree, if the air-fuel ratio that is discriminated from the output level of the oxygen concentration sensor 16 is lean, the count value COUNT of the trouble decision counter is set to "1" in step S5. If the count value COUNT is equal to or less than a predetermined value since COUNT=1, the oxygen concentration sensor trouble discrimination permission flag FO2 is set to "1" in step S8. This setting denotes that even if the operation in the rich operation region is continued and the air-fuel ratio that is discriminated from the output level of the oxygen concentration sensor 16 is held to be lean, the further discrimination relating to the trouble of the oxygen concentration sensor 16 is inhibited.

After that, when the engine 2 is operated in the air-fuel ratio feedback control region, the oxygen concentration sensor trouble discrimination permission flag FO2 is reset to "0" in step S9. This resetting denotes that if the operation in the rich operation region is again performed, the discrimination relating to the trouble of the oxygen concentration sensor 16 is permitted. Further, if the output level of the oxygen concentration sensor 16 is inverted during the operation in the air-fuel ratio feedback control region, the oxygen concentration sensor 16 is determined to be normal. In step S11, the count value COUNT of the trouble decision counter is cleared.

If the inversion of the output level of the oxygen concentration sensor 16 is not discriminated in step S10, however, and after that, if the engine 2 is again operated in the rich operation region and the air-fuel ratio that is discriminated from the output level of the oxygen concentration sensor 16 is lean, the count value COUNT of the trouble decision counter is further increased by only "1" in step S5. By repeating the operation as mentioned above, if the count value COUNT of the trouble decision counter exceeds a predetermined value, the oxygen concentration sensor 16 is decided to be in trouble in step S7. For example, an alarm is generated due to the decision of the trouble of the oxygen concentration sensor 16 and, at the same time, the subsequent air-fuel ratio feedback control is inhibited and the air-fuel ratio is open-loop controlled.

In the above embodiment, although each of the air-fuel ratio feedback control region and the rich operation region has been detected by the engine rotational speed and throttle valve opening degree, the invention is not limited to this method. Each of the air-fuel ratio feedback control region and the rich operation region can be also discriminated by using other engine parameters such as intake pipe inner pressure, intake air amount, cooling water temperature, and the like.

In the foregoing embodiment, although the sensor of the binary output type for inverting the level by using the stoichiometric air-fuel ratio as a threshold value has been used as an oxygen concentration sensor, an oxygen concentration sensor of a proportional output type in which an output level changes in proportion to oxygen concentration, namely, an air-fuel ratio can be also used.

Further, although the trouble decision counter has been formed on a program of the fail safe process in the embodiment, a hardware-like counter can be also used.

As mentioned above, according to the present invention, even when the output signal of the oxygen concentration sensor indicates the lean state of the air-fuel ratio and the trouble of the oxygen concentration sensor is detected during the operation in the rich operation region, unless it is confirmed that the output signal of the oxygen concentration sensor does not indicate the inversion of the rich and lean states of the air-fuel ratio in the air-fuel ratio feedback control operating state after that, the deciding operation of the trouble of the oxygen concentration sensor is not performed. In the case, therefore, where the trouble of the oxygen concentration sensor is detected during the operation of the internal combustion engine, whether the oxygen concentration sensor is in trouble or not can be determined during the operation while preventing an erroneous decision. Since there is no need to store that the trouble of the oxygen concentration sensor has been detected until the next operation of the engine, the construction of the apparatus is also simplified.

What is claimed is:

1. An oxygen concentration sensor trouble discriminating apparatus for discriminating trouble of an oxygen concentration sensor to detect an oxygen concentration in an exhaust gas of an internal combustion engine, comprising:

first operating state detecting means for detecting that said internal combustion engine is operating in a rich operation region where an air-fuel ratio of a supply mixture to said internal combustion engine is continuously held in a rich state;

lean air-fuel ratio detecting means for detecting that an output signal of said oxygen concentration sensor indicates a lean state of the air-fuel ratio when the operation in said rich operation region is detected;

second operating state detecting means for detecting whether said internal combustion engine is in a feedback control operating state in which a feedback control is performed to adjust the air-fuel ratio of the supply mixture in accordance with an output signal of said oxygen concentration sensor or not;

counting means for executing a counting operation every time a lean state of the air-fuel ratio is detected for the first time by said lean air-fuel ratio detecting means after the feedback control operating state was not detected by said second operating state detecting means;

means for returning the count value of said counting means to an initial value when the output signal of said oxygen concentration sensor indicates an inversion of the rich and lean states of the air-fuel ratio in the case where the feedback control operating state is detected by said second operating state detecting means; and means for deciding the trouble of said oxygen concentration sensor when the count value of said counting means is larger than a predetermined value.

* * * * *